US005390731A

United States Patent [19]

Selm et al.

[11] Patent Number: 5,390,731

[45] Date of Patent: Feb. 21, 1995

[54] HEAT EXCHANGER FIN

[75] Inventors: Gerald J. Selm, Connersville, Ind.; Kathleen L. Frazier, Farmington Hills, Mich.

[73] Assignee: Ford Motor Company, Dearborn, Mich.

[21] Appl. No.: 267,626

[22] Filed: Jun. 29, 1994

[51] Int. Cl.[6] ..... F28F 1/22

[52] U.S. Cl. ..... 165/152; 165/183

[58] Field of Search ..... 165/152, 153, 183

[56] References Cited

U.S. PATENT DOCUMENTS

| | | | |
|---|---|---|---|
| 2,018,922 | 10/1935 | Palmer | 165/152 |
| 2,329,789 | 9/1943 | Schank et al. | 72/196 X |
| 3,003,749 | 10/1961 | Morse | 165/152 |
| 3,433,044 | 3/1969 | Rhodes et al. | 72/186 |
| 3,695,347 | 10/1972 | Chartet | 165/152 |
| 3,724,538 | 4/1973 | Yamaguchi et al. | 165/152 |
| 3,998,600 | 12/1976 | Wallis | 72/187 X |
| 4,067,219 | 1/1978 | Bianchi | 72/186 |
| 5,209,289 | 5/1993 | Haushalter | 165/109.1 |

FOREIGN PATENT DOCUMENTS

| | | | |
|---|---|---|---|
| 4-106986 | 4/1993 | Japan | 165/183 |

*Primary Examiner*—Allen J. Flanigan

*Attorney, Agent, or Firm*—Raymond L. Coppiellie; Roger L. May

[57] ABSTRACT

A corrugated heat exchanging fin assembly for use with a heat exchanger having fluid conduits is disclosed. The fin assembly includes a plurality of fin elements, each fin element including a first plurality of louvers extending therefrom and disposed at a predetermined angle to the plane of the fin element. Each fin element further includes a second plurality of louvers extending therefrom and configured to intersect the plane of the fin element to prevent nesting of stacked rows of pluralities of fin assemblies.

6 Claims, 2 Drawing Sheets

HEAT EXCHANGER FIN

BACKGROUND OF THE INVENTION

1. Field of the Invention

The present invention relates to a corrugated fin type heat exchanger for an automotive vehicle. More particularly, the present invention relates to a corrugated fin assembly having an anti-nesting feature.

2. Disclosure Information

In general, a heat exchanger comprises fluid conduits and corrugated heat exchanging fins interposed between the conduits. Louvers are formed in the heat exchanging fins to improve their heat exchange efficiency. There are many known types of arrangements and designs of louvers. Typically louvers are directed at a predetermined angle with respect to the flow of air therepast to provide large heat exchange efficiency, a decrease pressure drop of the air across the elements and provide water shedding capability.

It is well known in the heat exchanger art to form the corrugated fins by passing flat strip stock between pairs of form rolls having intermeshing teeth around their outer peripheries which roll form the flat strip stock into generally expanded corrugated contours. Each of the fins defining the opposite sides of successive convolutions or corrugations are frequently lanced between the form rolls to form louvers in the fins and thus produce a more turbulent flow of air through the transversely extending passageways defined by the successive convolutions. This process is well known in the art.

After the fin assembly has been produced, a plurality of fin assemblies are stacked together for shipping prior to their utilization in the manufacturing of a heat exchanger core. Typically, the fin assemblies are packed to a specific density, i.e. fin assemblies per inch. The stacked assemblies are then transported to a work station where an operator physically removes a particular fin assembly for insertion into a heat exchanger core. However, due to the stacking of the fin assemblies to a specific density, the fin assemblies often nest within one another and become lodged therein making it difficult for an operator to remove successive layers of fin assemblies without damaging the assembly. Because the fin assemblies are typically formed of an aluminum alloy and are very thin, the fin assemblies are often damaged due to the forced removal by the operator of one assembly which has nested into another assembly, resulting in scrap. It would be desirable to provide a mechanism which prevents the fin assemblies from nesting into each other during the packing of the fin assemblies and ultimately reducing the scrap and waste produced during the manufacturing process.

The present invention overcomes the nesting problem of stacking a plurality of fin assemblies together by providing a specific fin louver design which prevents nesting of successive layers of fin assemblies.

SUMMARY OF THE INVENTION

The present invention provides a corrugated fin type heat exchanger including a plurality of fluid conduits which define a first series of passages for a first fluid and a corrugated strip defining a plurality of fin elements disposed between and thermally connected to each pair of adjacent fluid conduits and which cooperate therewith to define a second series of passages for air to flow therethrough. Each fin element of the plurality comprises a first plurality of louvers extending therefrom at a predetermined angle with respect to the flow of air and which are cut to define apertures open thereby. Each of these louvers include an outer edge disposed generally parallel to the plane of the fin element along substantially the entire length of the louver. Each fin element further comprises a second plurality of louvers extending therefrom and cut to define apertures therein, each of these louvers including a generally curvilinear outer edge with respect to the plane of the fin element to prevent nesting of stacked rows of fin assemblies.

It is an advantage of the present invention to reduce the amount of waste produced by preventing the nesting of the fin assemblies.

DETAILED DESCRIPTION OF THE PREFERRED EMBODIMENTS

Figure 1:
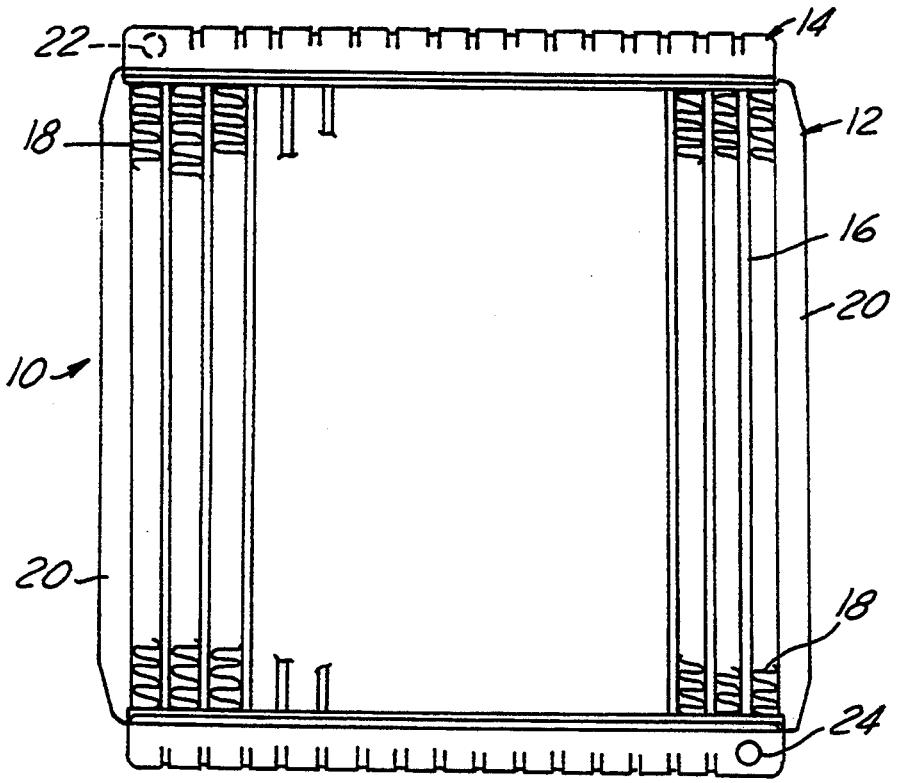
FIG. 1 is a cross-sectional view of a typical heat exchanger.

Referring now to the drawings, FIG. 1 shows an automotive heat exchanger 10, such as a radiator, including a core 12 comprising a plurality of tubes 16 interleaved with a plurality of fin assemblies 18 as is well known in the art.

The radiator 10 includes a manifold assembly 14 through which fluid flows into each of the tubes 16. As is known in the art, the radiator 10 can either include a single manifold disposed at one end at the core or may have a pair of manifolds disposed at opposite ends of the core. A pair of side supports 20 are disposed on opposite sides of the core 12 and provide structural rigidity to the radiator 10. The manifold 14 includes a fluid inlet at port 22 and fluid outlet at port 24 for the entry and exit of a fluid into the radiator 10. The present invention is being described with respect to a radiator, but may be used in other automotive heat exchangers, such as evaporators, heater cores, and oil coolers.

Figure 2:
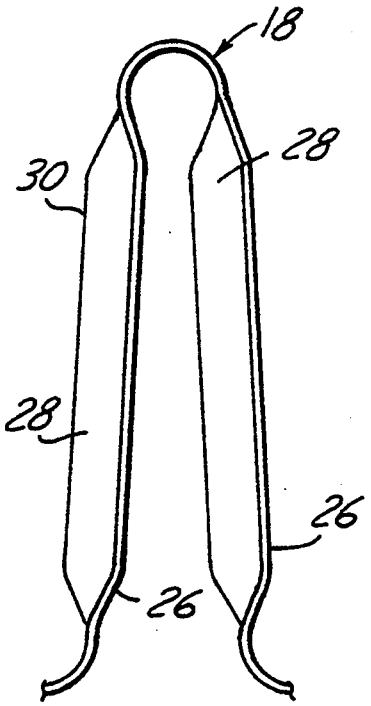
FIG. 2 is a cross-sectional view taken along line 2—2 of FIG. 1 of a portion of a fin assembly.

FIG. 2 illustrates a typical corrugated fin assembly of the present invention which includes a fin element 26 having formed thereon a louver 28. The louver 28 extends from the fin 26 at predetermined angle with respect to the flow of air and is formed by lancing to define an aperture opened in substantially the same direction thereof. The aperture allows the flow of air therethrough and directs the flow of air against the adjacent fluid conduit as is well known in the art. The louver 28 includes an outer edge 30 disposed generally parallel to the plane of the fin 26 along substantially the entire length of the louver 28.

Figure 3:
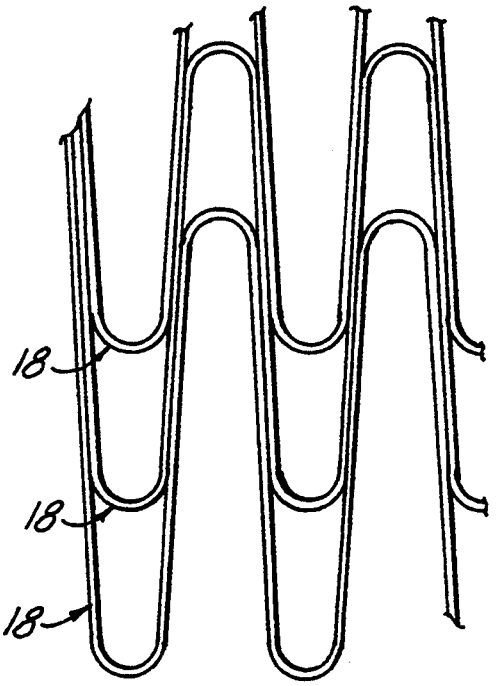
(PRIOR ART) FIG. 3
FIG. 3 is a cross-sectional view of a plurality of stacked fin assemblies.

FIG. 3 shows a plurality of fin elements 26 (louvers 28 have been excluded for ease of description) stacked after roll forming. As can be seen in FIG. 3 the crests and valleys of the convolutions of the fin assemblies 18 often nest within one another and become tightly lodged together. Removal of a specific layer of fin assembly from this stacked plurality often results in the damage to the fin assembly 18.

Figure 4:
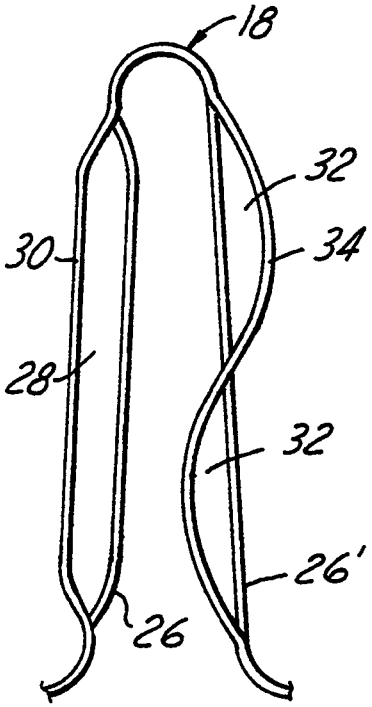
FIG. 4 is a cross-sectional view of a fin structured in accord with the present invention.

FIG. 4 shows a cross-sectional view of a single fin assembly structured according to the present invention which allows the stacking of the fin assemblies but prevents nesting of the plurality. As shown in FIG. 4, a convolution in the fin assembly 18 of the present invention includes a pair of fin elements 26, 26'. The fin element 26 includes a louver 28 as described above which includes an outer edge disposed substantially parallel to the plane of the fin element 26. The fin element 26' includes a curvilinear shaped louver 32 which is configured to intersect the plane of the fin element 26' to prevent nesting of the stacked rows of the plurality of fin assemblies 18. The outer edge 34 of the louver 32 is generally S-shaped in configuration.

Figure 5:
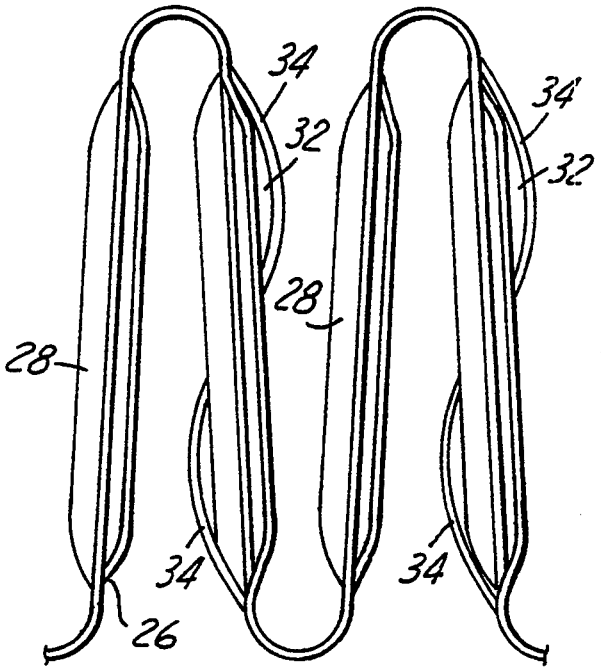
FIG. 5 is a cross-sectional view of a fin assembly of the present invention taken along line 5—5 of FIG. 1.

FIG. 5 shows a cross-sectional view of a fin assembly 18 showing the louvers of FIGS. 2 and FIGS. 4. As shown in FIG. 5, two convolutions of a fin assembly are shown having fin elements 26, 26' and louvers 28 and 32.

Figure 6:
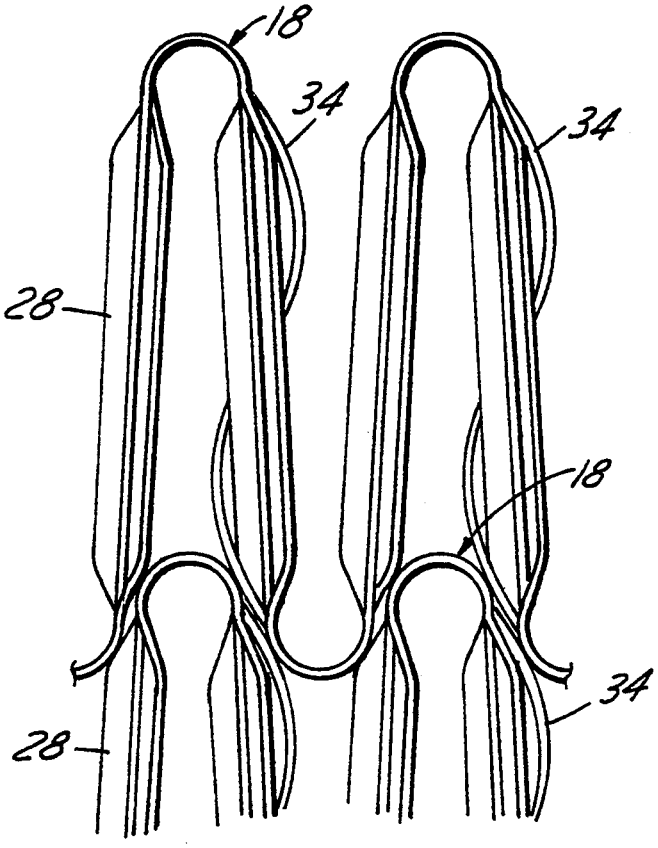
FIG. 6 is a cross-sectional view of a pair of stacked fin assemblies of the present invention.

FIG. 6 shows how the louvers 32 prevent the nesting of successively stacked rows of fin assemblies. As can be seen, the louvers 32 create an interference with the crests of the convolutions of the fin assemblies and thus prevent the tightly lodging nesting which was inherent in the typical prior art designs. In this manner, since the fin assemblies 18 do not become tightly lodged into one another, waste and scrap are reduced because deformation to the fin assembly is reduced when an operator removes a row of stacked fin assemblies from the group.

The fin assemblies 18 of the present invention are manufactured in a process which is well known and utilized by those skilled in the art. As is well known, a strip of fin material is formed between pairs of form rolls having intermeshing teeth around their outer peripheries which roll form the flat strips back into generally expanded convoluted or corrugated contours. After the convolutions are initially formed, the corrugated strip is gathered or compressed lengthwise to form a more acute bend at the crest of successive convolutions to thus bring the convolutions closer together and define the fluid passageways of desired shape, size and density extending transversely through the strip. Each of the fins defined on the opposite sides of successive convolutions are lanced between the form rolls to form the louvers and the fins and produce the more turbulent flow of heat exchange fluid, such as air. Typically, each of the teeth of the form rolls are identical so that the louvers are essentially the same size and shape. In the present invention, two of the teeth in the form roll are replaced by a tooth having a unique curved profile which, when utilized, produces a curvilinear outer edge of the louver of the present invention. Because the tooth of the gear roll form is thus formed in this manner, the number of curvilinear shaped louvers per each fin assembly will be a constant number. This helps to prevent the nesting of the fin assembly along its entire length.

Various other modifications and alterations to the present invention will, no doubt, become apparent to those skilled in the art. Therefore, it is the following claims, including all equivalents, which define the scope of the invention.

What is claimed is:

1. A corrugated heat exchanging fin assembly for use with a heat exchanger having conduits for a heat exchanging fluid, said fin assembly being adapted to be interposed between adjacent conduits and to allow the flow of air therethrough, said fin assembly including a plurality of fin elements, each fin element comprising:

a first plurality of louvers extending therefrom at a predetermined angle with respect to the flow of air and cut to define apertures opened in substantially the same direction thereof, each of said louvers of being disposed at a predetermined angle to the plane of said fin element; and a second plurality of louvers extending therefrom and cut to define apertures therein, each of said louvers of said second plurality being configured to intersect the plane of said fin element to prevent nesting of stacked rows of a plurality of fin assemblies.

2. A fin element according to claim 1, wherein each of said louvers of said first plurality of louvers includes an outer edge disposed generally parallel to the plane of said fin element along substantially the entire length of said louver.

3. A fin element according to claim 1, wherein each of said louvers of said second plurality of louvers includes a generally curvilinear outer edge with respect to the plane of said fin element.

4. A fin element according to claim 3, wherein said generally curvilinear outer edge of said louvers is generally S-shaped.

5. A fin element according to claim 1, wherein said fin element is formed from an aluminum alloy.

6. A corrugated fin type heat exchanger including a plurality of fluid conduits which define a first series of passages for a first fluid and a corrugated strip defining a plurality of fin elements disposed between and thermally connected to each pair of adjacent fluid conduits to cooperate therewith to define a second series of passages for air to flow therethrough, each fin element of said plurality comprising:

a first plurality of louvers extending therefrom at a predetermined angle with respect to the flow of air and cut to define apertures opened in substantially the same direction thereof, each of said louvers including an outer edge disposed generally parallel to the plane of said fin element along substantially the entire length of said louver; and a second plurality of louvers extending therefrom and cut to define apertures therein, each of said louvers of said second plurality including a generally S-shaped curvilinear outer edge with respect to the plane of said fin element to prevent nesting of stacked rows of a plurality of fin assemblies.

* * * * *